US011058238B1

(12) United States Patent
Toomey

(10) Patent No.: US 11,058,238 B1
(45) Date of Patent: Jul. 13, 2021

(54) ROTATING RING DISPLAY DEVICE

(71) Applicant: Mark Toomey, Fredericksburg, TX (US)

(72) Inventor: Mark Toomey, Fredericksburg, TX (US)

( * ) Notice: Subject to any disclaimer, the term of this patent is extended or adjusted under 35 U.S.C. 154(b) by 0 days.

(21) Appl. No.: 16/922,012

(22) Filed: Jul. 7, 2020

(51) Int. Cl.
*A47F 7/02* (2006.01)
*A47F 5/025* (2006.01)

(52) U.S. Cl.
CPC ..... *A47F 7/02* (2013.01); *A47F 5/025* (2013.01)

(58) Field of Classification Search
CPC ..... A45C 11/16; G09F 19/08; G09F 19/02; G09F 11/02; A47F 7/02; A47F 5/025; A47F 5/02; A47F 7/022; A47F 7/024; A47F 7/03; A47F 5/03; A47F 3/08; A47F 3/10; A47F 3/11; A47B 49/008; A47B 81/065
USPC ..... 211/85.2, 70, 163; 40/430, 473; 206/6.1, 206/301, 566
See application file for complete search history.

(56) References Cited

U.S. PATENT DOCUMENTS 1,945,072 A * 1/1934 Quigley Wirts ..... A47F 5/025 40/415
D145,738 S 10/1946 Lewis
3,654,716 A * 4/1972 Moss ..... G09F 11/02 40/473
4,008,534 A * 2/1977 Swartz ..... G09F 19/02 40/431
4,341,300 A 7/1982 Roy
4,764,850 A * 8/1988 Albanese ..... G09F 19/16 136/291
4,983,890 A * 1/1991 Satoh ..... A63H 13/04 318/3
5,109,989 A * 5/1992 Kremmin ..... A47F 5/025 108/20
5,345,153 A * 9/1994 Vaught ..... A47G 33/0809 248/915
5,479,153 A * 12/1995 Yi ..... G09F 19/02 340/815.58
5,649,625 A 7/1997 Ovadia
5,696,333 A * 12/1997 Shih ..... A45C 11/16 206/6.1
5,779,032 A * 7/1998 Limura ..... G08C 23/04 206/459.1
6,209,242 B1 * 4/2001 Marshall ..... G09F 19/02 206/566
6,348,964 B1 * 2/2002 Wagner ..... G01N 21/87 356/30
6,588,585 B1 * 7/2003 Allen-Carpenter .... A45C 11/16 206/566
7,325,940 B2 * 2/2008 Cea ..... A45C 11/16 206/566

(Continued)

*Primary Examiner* — Jennifer E. Novosad

(57) ABSTRACT

The rotating ring display device is a display device. The rotating ring display device is configured for use in displaying a jewelry item know as a ring. The ring mounts on the rotating ring display device for display. The rotating ring display device is a rotating structure. The rotating ring display device rotates the ring such that the ring can be viewed from a variety of angles. The rotating ring display device comprises a pedestal structure, a ring display structure, and a control circuit. The pedestal structure contains the control circuit. The ring display structure attaches to the pedestal structure. The ring display structure receives and displays the ring. The control circuit rotates the ring display structure.

14 Claims, 4 Drawing Sheets

(56) References Cited

U.S. PATENT DOCUMENTS

| | | | | |
|---|---|---|---|---|
| 8,212,868 | B2 * | 7/2012 | High | A47F 11/06 348/94 |
| 8,499,940 | B2 * | 8/2013 | Johnson | A47F 5/025 211/1.53 |
| 9,222,663 | B1 * | 12/2015 | Yang | F21V 31/04 |
| 9,375,066 | B1 * | 6/2016 | Velazquez | A45C 13/02 |
| 9,743,494 | B1 | 8/2017 | McCrory | |
| D850,455 | S * | 6/2019 | Cheng | D14/440 |
| 10,598,323 | B1 * | 3/2020 | Schaak | G09F 19/02 |
| 2004/0231204 | A1 * | 11/2004 | Tyler | G09F 19/02 40/427 |
| 2006/0205320 | A1 * | 9/2006 | Fekete | G09F 19/02 446/484 |
| 2007/0144921 | A1 * | 6/2007 | Mobley | A47F 7/024 206/6.1 |
| 2008/0041734 | A1 * | 2/2008 | Bergelson | A47F 7/02 206/6.1 |
| 2008/0251396 | A1 * | 10/2008 | Oh | A45C 11/16 206/6.1 |
| 2009/0200183 | A1 * | 8/2009 | Dussin | A47F 7/03 206/6.1 |
| 2019/0228443 | A1 * | 7/2019 | McGwire | G06Q 30/0281 |
| 2020/0290795 | A1 * | 9/2020 | Freilich | A47F 7/0078 |

* cited by examiner

ROTATING RING DISPLAY DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of display stands for shops, more specifically, a rotating display stand. (A47F5/025)

SUMMARY OF INVENTION

The rotating ring display device is a display device. The rotating ring display device is configured for use in displaying a jewelry item know as a ring. The ring mounts on the rotating ring display device for display. The rotating ring display device is a rotating structure. The rotating ring display device rotates the ring such that the ring can be viewed from a variety of angles. The rotating ring display device comprises a pedestal structure, a ring display structure, and a control circuit. The pedestal structure contains the control circuit. The ring display structure receives and displays the ring. The control circuit rotates the ring display structure.

These together with additional objects, features and advantages of the rotating ring display device will be readily apparent to those of ordinary skill in the art upon reading the following detailed description of the presently preferred, but nonetheless illustrative, embodiments when taken in conjunction with the accompanying drawings.

In this respect, before explaining the current embodiments of the rotating ring display device in detail, it is to be understood that the rotating ring display device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the rotating ring display device.

It is therefore important that the claims be regarded as including such equivalent construction insofar as they do not depart from the spirit and scope of the rotating ring display device. It is also to be understood that the phraseology and terminology employed herein are for purposes of description and

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
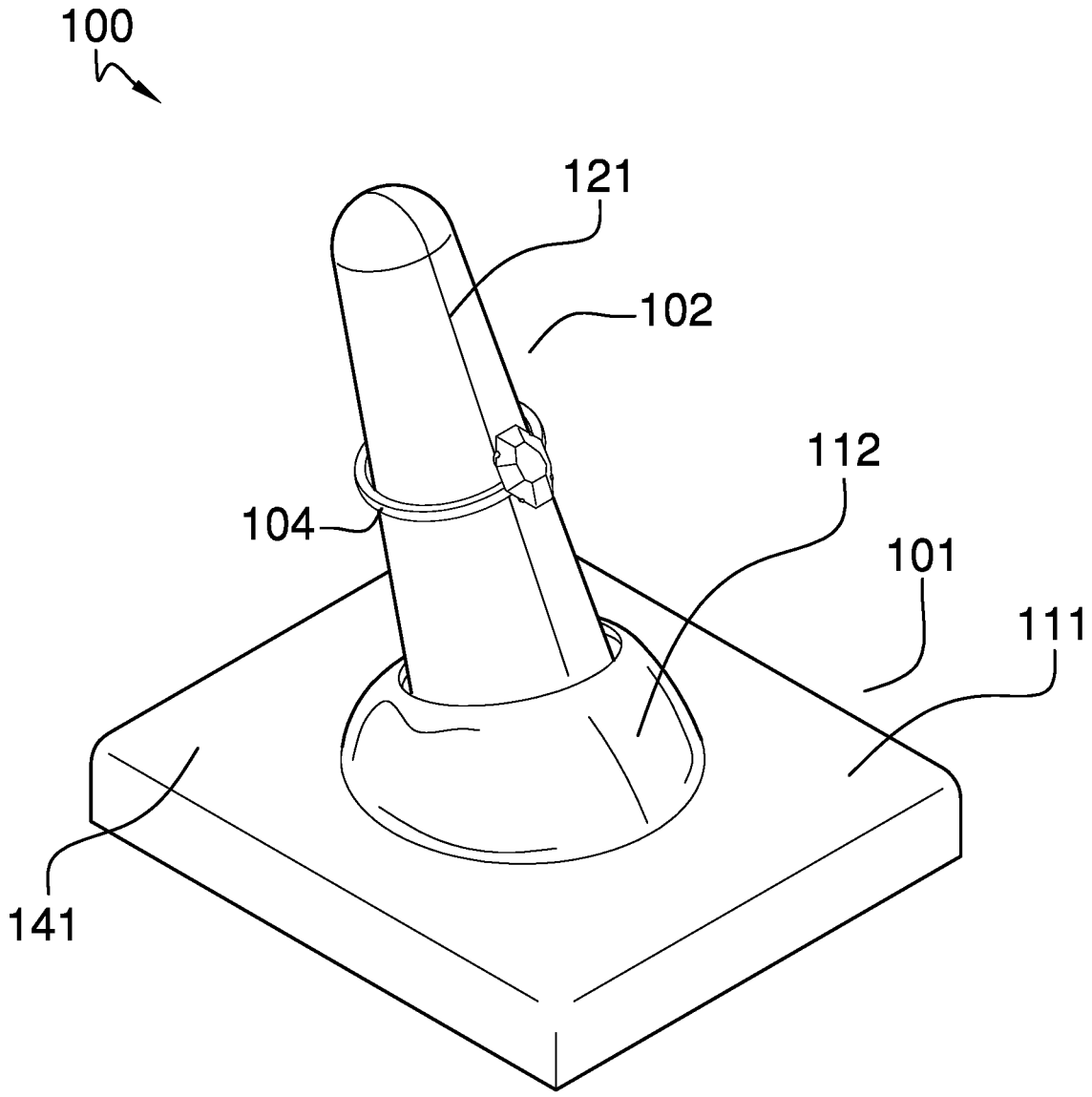
FIG. 1 is a perspective view of an embodiment of the disclosure.
Figure 2:
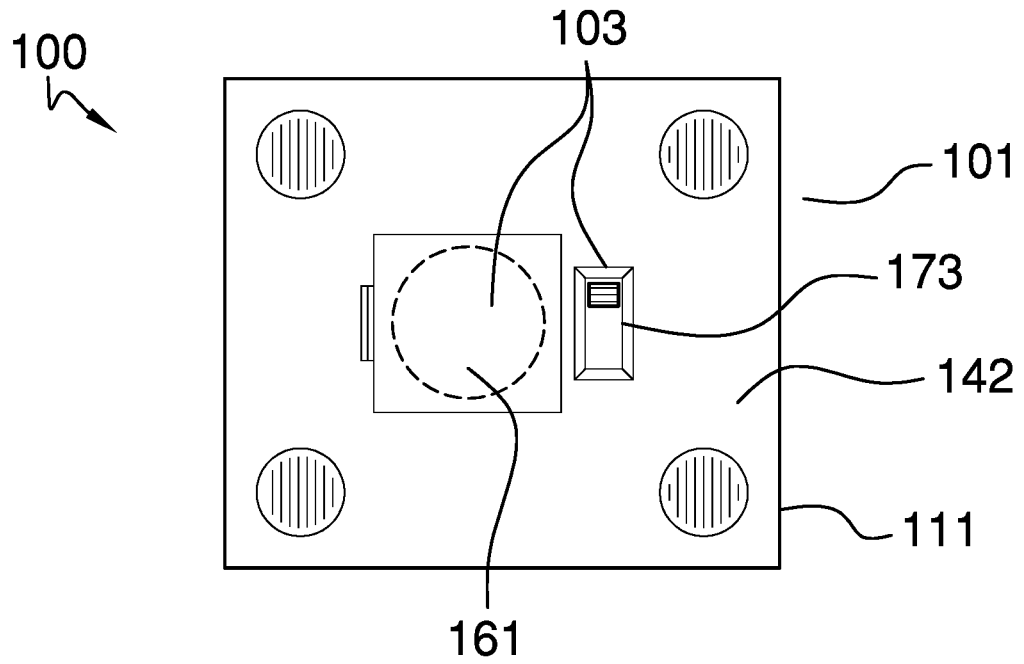
FIG. 2 is a bottom view of an embodiment of the disclosure.
Figure 3:
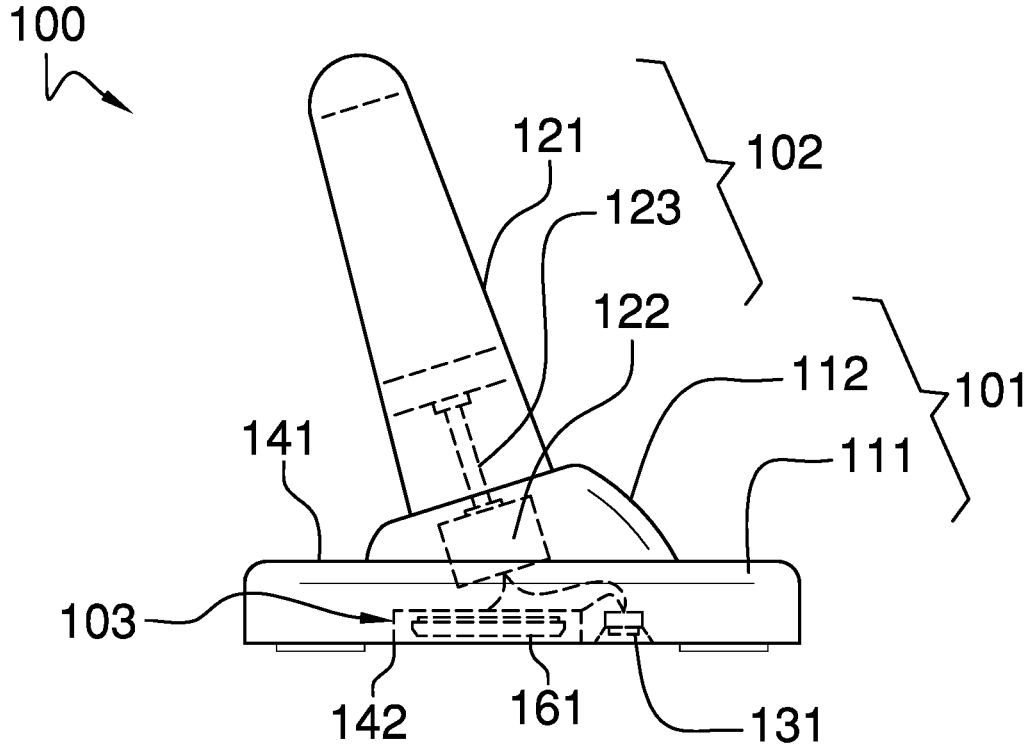
FIG. 3 is a side view of an embodiment of the disclosure.
Figure 4:
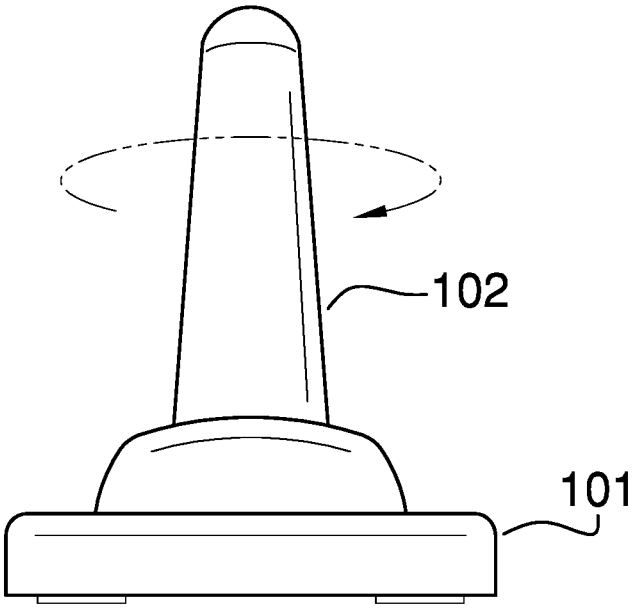
FIG. 4 is a front view of an embodiment of the disclosure.
Figure 5:
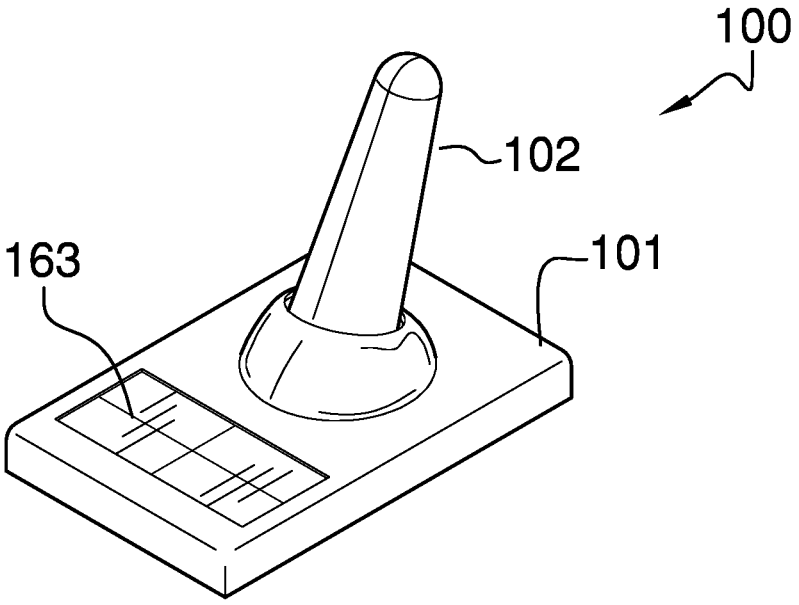
FIG. 5 is a perspective view of an alternate embodiment of the disclosure.
Figure 6:
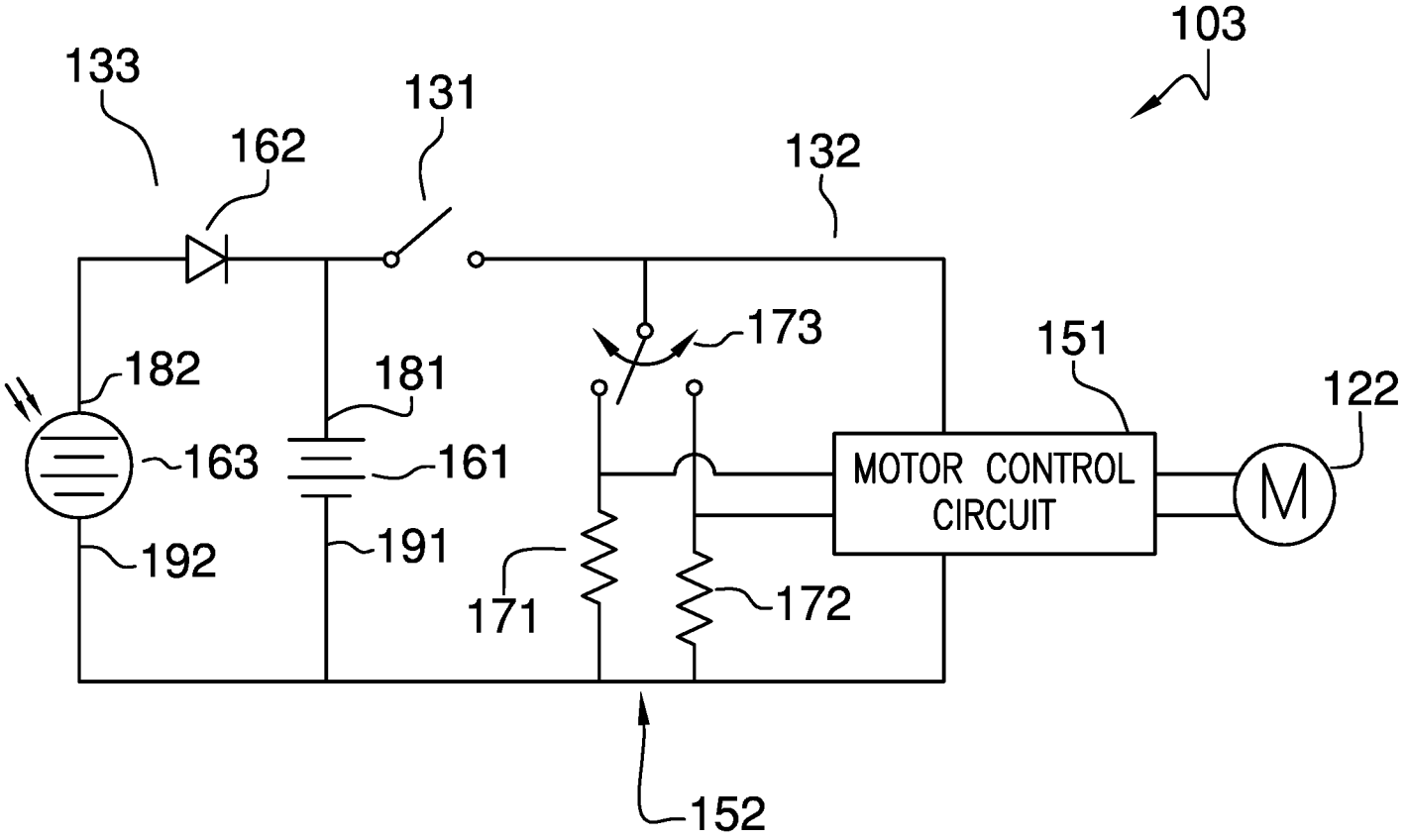
FIG. 6 is a schematic view of an embodiment of the disclosure.

Detailed reference will now be made to one or more potential embodiments of the disclosure, which are illustrated in FIGS. 1 through 6.

The rotating ring display device 100 (hereinafter invention) is a display device. The invention 100 is configured for use in displaying a jewelry item know as a ring 104. The ring 104 is a jewelry item that loops around a finger or toe when worn. The ring 104 mounts on the invention 100 for display. The invention 100 is a rotating structure. The invention 100 rotates the ring 104 such that the ring 104 can be viewed from a variety of angles. The invention 100 comprises a pedestal structure 101, a ring 104 display structure 102, and a the master control circuit 103. The ring 104 display structure 102 attaches to the pedestal structure 101. The ring 104 display structure 102 receives and displays the ring 104. The master control circuit 103 rotates the ring 104 display structure 102.

The pedestal structure 101 is a rigid casing. The pedestal structure 101 is a disk-shaped structure. The pedestal structure 101 forms the final link of the load path that transfers the load of the ring 104 display structure 102, the master control circuit 103, and the ring 104 to a supporting surface. The pedestal structure 101 contains the master control circuit 103. The ring 104 display structure 102 mounts on the exterior surface of the pedestal structure 101. The pedestal structure 101 is formed with all apertures and form factors necessary to allow the pedestal structure 101 to accommodate the use and operation of the invention 100. Methods to form a pedestal structure 101 suitable for the purposes described in this disclosure are well-known and documented in the mechanical arts.

The master control circuit 103 is an independently powered electric circuit. By independently powered is meant that the master control circuit 103 can operate without an electrical The pedestal structure 101 comprises a pedestal plate 111 and a ring 104 display mount 112.

The pedestal plate 111 is a rigid casing. The pedestal plate 111 is a disk-shaped structure. The pedestal plate 111 is a hollow structure. The pedestal plate 111 forms the final link of the load path that transfers the load of the ring 104 display structure 102, the master control circuit 103, and the ring 104 to a supporting surface. The pedestal plate 111 contains the master control circuit 103. The ring 104 display structure 102 mounts on the exterior surface of the pedestal plate 111. The pedestal plate 111 is formed with all apertures and form factors necessary to allow the pedestal plate 111 to accommodate the use and operation of the invention 100. Methods to form a pedestal plate 111 suitable for the purposes described in this disclosure are well-known and documented in the mechanical arts. The pedestal plate 111 further comprises a superior surface 141 and an inferior surface 142.

The inferior surface 142 is a congruent end of the disk structure of the pedestal plate 111. The inferior surface 142 is the congruent end of the pedestal plate 111 that rests on the supporting surface. The master switch 131 of the master control circuit 103 is accessible from the inferior surface 142. The master control circuit 103 is accessible from the inferior surface 142.

The superior surface 141 is a congruent end of the disk structure of the pedestal plate 111. The superior surface 141 is the congruent end of the pedestal plate 111 that is distal from the inferior surface 142. The ring 104 display mount 112 attaches the ring 104 display structure 102 to the superior surface 141 of the pedestal plate 111.

The ring 104 display mount 112 is a mechanical structure. The ring 104 display mount 112 attaches the ring 104 display structure 102 to the superior surface 141 of the pedestal plate 111. The ring 104 display mount 112 attaches the ring 104 display structure 102 to the pedestal plate 111 such that the ring 104 display structure 102 rotates relative to the pedestal plate 111. The ring 104 display mount 112 attaches the ring 104 display structure 102 to the pedestal plate 111 to form a cantilever structure.

The ring 104 display structure 102 is a mechanical structure. The ring 104 display structure 102 receives and displays the ring 104. The ring 104 display structure 102 attaches to the superior surface 141 of the pedestal plate 111. The ring 104 display structure 102 attaches to the pedestal plate 111 in the manner of a cantilever. The ring 104 mounts on of the cantilever structure formed by the ring 104 display structure 102. The ring 104 display structure 102 is a rotating structure. Specifically, the cantilever structure formed by the ring 104 display structure 102 rotates relative to the pedestal plate 111 of the pedestal structure 101. The master control circuit 103 controls the rotation of the ring 104 display structure 102. The rotation of the ring 104 display structure 102 changes the viewing angle of the ring 104 while the ring 104 is on display. The ring 104 display structure 102 comprises a display prism 121, a drive motor 122, and a drive shaft 123.

The display prism 121 is a mechanical structure. The display prism 121 forms the cantilever structure of the ring 104 display structure 102. The span of the length of the outer dimension of the display prism 121 is lesser than the span of the length of the inner dimension of the aperture of the ring 104 such that the ring 104 slides over the free end of the cantilever structure of the display prism 121. The display prism 121 is the rotating structure of the ring 104 display structure 102. The display prism 121 rotates around an axis of rotation that aligns with the center axis of the tapered prism structure of the display prism 121. The display prism 121 has a tapered prism structure. The congruent end of the tapered prism structure of the display prism 121 with the least surface area display prism 121. In the first potential embodiment of the disclosure, the free end of the display prism 121 is rounded.

The drive motor 122 is an electric motor. The drive motor 122 converts electric energy into the rotational mechanical energy used to rotate the display prism 121 within the ring 104 display mount 112. The master control circuit 103 controls the operation of the drive motor 122.

The drive shaft 123 is a prism-shaped structure. The drive shaft 123 attaches the display prism 121 to the drive motor 122. The drive shaft 123 attaches to the congruent end of the tapered prism structure that forms the fixed end of the cantilever structure of the display prism 121. The drive shaft 123 forms a composite prism structure with the display prism 121 such that the drive shaft 123 and the display prism 121 are aligned to share the same axis of rotation. The drive shaft 123 forms a composite prism structure with the rotor of the drive motor 122 such that the drive shaft 123 and the drive motor 122 are aligned to share the same axis of rotation. The rotation of the drive shaft 123 by the drive motor 122 in turn rotates the display prism 121 around the center axis of the tapered prism structure of the display prism 121.

The master control circuit 103 is an electric circuit. The master control circuit 103 controls the operation of the drive of the display prism 121 by controlling the operation of the drive motor 122. The master control circuit 103 rotates the display prism 121 in a mode selected from the group consisting of a first mode and a second mode. In the first mode, the master control circuit 103 rotates the display prism 121 around a 360 degree arc. In the second mode, the master control circuit 103 rotates the back and forth across a 120 degree arc. By back and forth is meant that the master control circuit 103 alternates between a clockwise rotation and a counterclockwise rotation across a fixed 120 degree arc. The master control circuit 103 comprises a master switch 131, a rotation circuit 132, and a power circuit 133. The master switch 131, the rotation circuit 132, and the power circuit 133 are electrically interconnected.

The master switch 131 is an electric switch. The master switch 131 is a maintained switch. The switch and the maintained switch are defined elsewhere in this disclosure. The master switch 131 forms a series electric connection between the power circuit 133 and the rotation circuit 132. The master switch 131 controls the flow of electricity from the power circuit 133 to the rotation circuit 132. The master switch 131 controls the operation of the invention 100 by controlling the flow of electric power into the rotation circuit 132.

The rotation circuit 132 is an electric circuit. The rotation circuit 132 controls the operation of the drive motor 122. The rotation circuit 132 operates in the first mode to rotate the display prism 121 around an arc of 360 degrees. The rotation circuit 132 operates in the second mode to rotate the display prism 121 back and forth across an arc of 120 degrees. The rotation circuit 132 discontinues the operation of the drive motor 122 when the master switch 131 is actuated to an open position. The rotation circuit 132 comprises a motor control circuit 151 and a mode selection circuit 152. The motor control circuit 151 and the mode selection circuit 152 are electrically interconnected.

The motor control circuit 151 is an electric circuit. The motor control circuit 151 is defined elsewhere in this disclosure. The motor control circuit 151 transfers electric power from the master switch 131 to the drive motor 122.

The motor control circuit 151 controls the operation of the drive motor 122 of the ring 104 display structure 102. Specifically, the motor control circuit 151 controls the direction of rotation of the drive motor 122. The motor control circuit 151 controls the speed of rotation of the drive motor 122. The motor control circuit 151 operates in the first mode to rotate the drive motor 122 around an arc of 360 degrees. The motor control circuit 151 operates in the second mode to rotate the drive motor 122 back and forth across an arc of 120 degrees.

The mode selection circuit 152 is an electric circuit. The mode selection circuit 152 is a switching circuit. The mode selection circuit 152 presents the motor control circuit 151 with a first voltage indicating to the motor control circuit 151 to operate the drive motor 122 in the first mode. The mode selection circuit 152 presents the motor control circuit 151 with a second voltage indicating to the motor control circuit 151 to operate the drive motor 122 in the second mode. The mode selection circuit 152 comprises a first load resistor 171, a second load resistor 172, and a single throw double pole switch 173. The first load resistor 171, the second load resistor 172, and the single throw double pole switch 173 are electrically interconnected.

The single throw double pole switch 173 is an electric switch. The single throw double pole switch 173 is defined elsewhere in this disclosure. The single throw double pole switch 173 actuates to a first position. In the first position, the single throw double pole switch 173 forms a series electric connection between the master switch 131 and the first load resistor 171. The single throw double pole switch 173 actuates to a second position. In the second position, the single throw double pole switch 173 forms a series electric connection between the master switch 131 and the second load resistor 172.

The first load resistor 171 is a resistive circuit element. The first load resistor 171 forms a series electric connection between the first position of the single throw double pole switch 173 and the power circuit 133. The first load resistor 171 forms a series electric connection between the first position of the single throw double pole switch 173 and the first negative terminal 191 of the battery 161 of the power circuit 133. When the master switch 131 is actuated to the closed position while the single throw double pole switch 173 is simultaneously actuated to the first position, the first load resistor 171 presents the first voltage to the motor control circuit 151 that indicates that the motor control circuit 151 operates in the first mode.

The second load resistor 172 is a resistive circuit element. The second load resistor 172 forms a series electric connection between the second position of the single throw double pole switch 173 and the power circuit 133. The second load resistor 172 forms a series electric connection between the second position of the single throw double pole switch 173 and the first negative terminal 191 of the battery 161 of the power circuit 133. When the master switch 131 is actuated to the closed position while the single throw double pole switch 173 is simultaneously actuated to the second position, the second load resistor 172 presents the second voltage to the motor control circuit 151 that indicates that the motor control circuit 151 operates in the second mode.

The power circuit 133 is an electrical circuit. The power circuit 133 powers the operation of the master control circuit 103. The power circuit 133 is an electrochemical device. The power circuit 133 converts chemical potential energy into the electrical energy required to power the master control circuit 103. The power circuit 133 comprises a battery 161, a diode 162, and a photovoltaic cell 163. The battery 161 further comprises a first positive terminal 181 and a first negative terminal 191. The photovoltaic cell 163 further comprises a second positive terminal 182 and a second negative terminal 192. The battery 161, the diode 162, and the photovoltaic cell 163 are electrically interconnected.

The battery 161 is a commercially available rechargeable battery 161. The battery 161 is an electrochemical device. The battery 161 converts chemical potential energy into the electrical energy used to power the master control circuit 103. The photovoltaic cell 163 is an electrical device that converts light into electrical energy. The chemical energy stored within the rechargeable battery 161 is further renewed and restored through the use of the photovoltaic cell 163.

The photovoltaic cell 163 is directly wired to the battery 161. The photovoltaic cell 163 is an electrical circuit that reverses the polarity of the rechargeable battery 161 and provides the energy necessary to reverse the chemical processes that the rechargeable battery 161 initially used to generate the electrical energy. This reversal of the chemical process creates a chemical potential energy that will later be used by the rechargeable battery 161 to generate electricity.

The diode 162 is an electrical device that allows current to flow in only one direction. The diode 162 installs between the rechargeable battery 161 and the photovoltaic cell 163 such that electricity will not flow from the first positive terminal 181 of the rechargeable battery 161 into the second positive terminal 182 of the photovoltaic cell 163. The photovoltaic cell 163 is defined elsewhere in this disclosure.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Arc: As used in this disclosure, an arc refers to a portion of a circumference or a curved perimeter. When applied to an angle, the arc also refers to a measure of an angular span as measured from a circle at the vertex formed by the sides of the angle.

Battery: As used in this disclosure, a battery is a chemical device consisting of one or more cells, in which chemical energy is converted into electricity and used as a source of power. Batteries are commonly defined with a positive terminal and a negative terminal.

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Clockwise: As used in this disclosure, clockwise refers to a direction of rotation as it appears to a viewer. The clockwise direction is defined as the rotational direction that is opposite to the counterclockwise direction.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Control Circuit: As used in this disclosure, a control circuit is an electrical circuit that manages and regulates the behavior or operation of a device.

Correspond: As used in this disclosure, the term correspond is used as a comparison between two or more objects wherein one or more properties shared by the two or more objects match, agree, or align within acceptable manufacturing tolerances.

Counterclockwise: As used in this disclosure, counterclockwise refers to a direction of rotation as it appears to a viewer. The counterclockwise direction is defined using a right hand rule. Specifically, when the viewer: 1) puts their right hand between the rotating object and themselves; and, 2) from this position points the thumb of their right hand directly at themselves; then, 3) when the viewer rotates their wrist, the fingers of the right hand will rotate in the counterclockwise direction.

Diode: As used in this disclosure, a diode is a two terminal semiconductor device that allows current flow in only one direction. The two terminals are called the anode and the cathode. Electric current is allowed to pass from the anode to the cathode.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Electric Circuit: As used in this disclosure, an electric circuit is a closed loop path through which electrons flow. The closed loop will generally initiate and terminate at an electrical power source.

Electric Motor: In this disclosure, an electric motor is a machine that converts electric energy into rotational mechanical energy. An electric motor typically comprises a stator and a rotor. The stator is a stationary hollow cylindrical structure that forms a magnetic field. The rotor is a magnetically active rotating cylindrical structure that is coaxially mounted in the stator. The magnetic interactions between the rotor and the stator physically causes the rotor to rotate within the stator thereby generating rotational mechanical energy. This disclosure assumes that the power source is an externally provided source of DC electrical power. The use of DC power is not critical and AC power can be used by exchanging the DC electric motor with an AC motor that has a reversible starter winding.

External Power Source: As used in this disclosure, an external power source is a source of the energy that is externally provided to enable the operation of the present disclosure. Examples of external power sources include, but are not limited to, electrical power sources and compressed air sources.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Housing: As used in this disclosure, a housing is a rigid structure that encloses and protects one or more devices.

Inferior: As used in this disclosure, the term inferior refers to a directional reference that is parallel to and in the same direction as the force of gravity when an object is positioned or used normally.

Inner Dimension: As used in this disclosure, the term inner dimension describes the span from a first inside or interior surface of a container to a second inside or interior surface of a container. The term is used in much the same way that a plumber would refer to the inner diameter of a pipe.

Jewelry: As used in this disclosure, jewelry is a personal decorative item that is worn by a person. Examples of jewelry include, but are not limited to, necklaces, bracelets, rings, earrings, cufflinks, brooches, and wristwatches.

Load Resistor: As used in this disclosure, a load resistor is an electrical resistor that is used to present a voltage to an electrical device. The presented voltage is controlled by controlling the amount of electrical current passing through the load resistor.

Logic Circuit: As used in this disclosure, a logic circuit is non-programmable electrical device that receives one or more digital or analog inputs and uses those digital or analog inputs to generate one or more digital or analog outputs.

Maintained Switch: A used in this disclosure, a maintained switch is a switch that maintains the position that was set in the most recent switch actuation. A maintained switch works in an opposite manner to a momentary switch.

Momentary Switch: As used in this disclosure, a momentary switch is a biased switch in the sense that the momentary switch has a baseline position that only changes when the momentary switch is actuated (for example when a pushbutton switch is pushed or a relay coil is energized). The momentary switch then returns to the baseline position once the actuation is completed. This baseline position is called the "normal" position. For example, a "normally open" momentary switch interrupts (open) the electric circuit in the baseline position and completes (closes) the circuit when the momentary switch is activated. Similarly, a "normally closed" momentary switch will complete (close) an electric circuit in the baseline position and interrupt (open) the circuit when the momentary switch is activated.

Motor: As used in this disclosure, a motor refers to the method of transferring energy from an external power source into rotational mechanical energy.

Motor Controller: As used in this disclosure, a motor controller is an electrical device that is used to control the rotational speed, or simply the speed of the motor, and the direction of rotation of an electric motor. Motor controllers will generally receive one or more inputs which are used to determine the desired rotational speed and direction of rotation Mount: As used in this disclosure, a mount is a mechanical structure that attaches or incorporates a first object to a second object.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Parallel Circuit: As used in this disclosure, a parallel circuit refers to a method of electrically connecting a plurality of circuit elements to a voltage source. In a parallel circuit each circuit element receives a voltage equal to the full voltage produced by the voltage source.

Pedestal: As used in this disclosure, a pedestal is an intermediary load bearing structure that that forms a load path between two objects or structures.

Perimeter: As used in this disclosure, a perimeter is one or more curved or straight lines that bounds an enclosed area on a plane or surface. The perimeter of a circle is commonly referred to as a circumference.

Photovoltaic Cell: As used in this disclosure, a photovoltaic cell is a photoelectric device that directly converts light energy into electrical energy.

Plug: As used in this disclosure, a plug is an electrical termination that electrically connects a first electrical circuit to a second electrical circuit or a source of electricity. As used in this disclosure, a plug will have two or three metal pins.

Poles, Throws, and Switches: As used in this disclosure, the terms pole and throw are descriptions associated with an electrical switch. A pole refers to an electrical circuit the switch feeds electrical current into. The number of poles associated with the switch refers to the maximum number of independent circuits a switch can theoretically support.

Because the circuits supported by the poles of a switch can be interconnected, a switch will often support fewer independent electrical circuits than the actual number of poles. The number of throws associated with a switch refers to the maximum number of electrical connections that can be made within an individual pole of the switch.

Port: As used in this disclosure, a port is an electrical termination that is used to connect a first electrical circuit to a second external electrical circuit. In this disclosure, the port is designed to receive a plug.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Resistance: As used in this disclosure, resistance refers to the opposition provided by an electrical circuit (or circuit element) to the electrical current created by a DC voltage is presented across the electrical circuit (or circuit element). The term impedance is often used for resistance when referring to an AC voltage that is presented across the electrical circuit (or circuit element).

Resistor: As used in this disclosure, a resistor is a well-known and commonly available electrical device that presents a resistance that inhibits the flow of electricity through an electric circuit. Within an electric circuit processing alternating currents, the resistor will not affect the phase of the alternating current. A current flowing through a resistor will create a voltage across the terminals of the resistor.

Ring: As used in this disclosure, a ring is term that is used to describe a disk-like structure through which a negative space is formed. Rings are often considered loops.

Rounded: A used in this disclosure, the term rounded refers to the replacement of an apex, vertex, or edge or brink of a structure with a (generally smooth) curvature wherein the concave portion of the curvature faces the interior or center of the structure.

Series Circuit: As used in this disclosure, a series circuit refers to a method of electrically connecting a plurality of circuit elements to a voltage source. In a series circuit, the proportion of the voltage received by each individual circuit element is divided proportionally between the plurality circuit elements based on the resistance (or impedance) of each circuit element relative to the total resistance of the plurality of circuit elements. The series circuit forms a linear or loop structure often referred to as a daisy chain.

Superior: As used in this disclosure, the term superior refers to a directional reference that is parallel to and in the opposite direction of the force of gravity when an object is positioned or used normally.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Switching Circuit: As used in this disclosure, a switching circuit is non-programmable electrical device that receives one or more digital or analog inputs and uses those digital or analog inputs to generate one or more digital or analog outputs.

Tapered Prism Structure: As used in this disclosure, a tapered prism structure is a modified prism structure that is formed such that the first congruent end of the modified prism structure is geometrically similar to, but not geometrically identical to the second congruent end of the modified prism. The span of the length of a radial line from the center axis to the lateral face of the modified prism structure will vary as a function of its position along the center axis.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A rotating ring display device comprising
- a pedestal structure, a ring display structure, and a master control circuit;
- wherein the pedestal structure contains the master control circuit;
- wherein the ring display structure attaches to the pedestal structure;
- wherein the rotating ring display device is configured for use in displaying a ring;
- wherein the ring is configured to mount on the rotating ring display device for display;
- wherein the master control circuit is an electric circuit;
- wherein the master control circuit controls operation of a drive motor;
- wherein the master control circuit controls a rotation of a display prism by controlling the operation of the drive motor;
- wherein the master control circuit rotates the display prism in a mode selected from the group consisting of a first mode and a second mode;
- wherein the drive motor is an electric motor;
- wherein the drive motor converts electric energy into rotational mechanical energy used to rotate the display prism within a ring display mount;
- wherein the master control circuit controls the operation of the drive motor;
- wherein the drive shaft attaches to a congruent end of the tapered prism structure that forms a fixed end of a cantilever structure of the display prism;
- wherein the drive shaft forms a composite prism structure with a rotor of the drive motor such that the drive shaft and the drive motor are aligned to share the same axis of rotation;
- wherein a rotation of the drive shaft by the drive motor in turn rotates the display prism around a center axis of the tapered prism structure of the display prism.

2. The rotating ring display device according to claim 1
- wherein the rotating ring display device is a rotating structure;
- wherein the rotating ring display device is configured to rotate the ring;
- wherein the master control circuit rotates the ring display structure.

3. The rotating ring display device according to claim 2
- wherein the pedestal structure is a rigid casing;
- wherein the pedestal structure is a disk-shaped structure;
- wherein the pedestal structure forms a final link of the load path that transfers the load of the ring display structure, the master control circuit, and the ring to a supporting surface.

4. The rotating ring display device according to claim 3 wherein the master control circuit is an independently powered electric circuit.

5. The rotating ring display device according to claim 4
- wherein the ring display structure is a mechanical structure;
- wherein the ring display structure is configured to receive and display the ring;
- wherein the ring display structure attaches to a superior surface of a pedestal plate;
- wherein the ring display structure attaches to the pedestal plate;
- wherein the ring is configured to mount on the ring display structure by sliding over a free end of a cantilever structure formed by the ring display structure.

6. The rotating ring display device according to claim 5
- wherein the cantilever structure formed by the ring display structure rotates relative to the pedestal plate of the pedestal structure;
- wherein the master control circuit controls the rotation of the ring display structure.

7. The rotating ring display device according to claim 6
- wherein the master control circuit comprises a master switch, a rotation circuit, and a power circuit;
- wherein the master switch, the rotation circuit, and the power circuit are electrically interconnected.

8. The rotating ring display device according to claim 7 wherein the pedestal plate is a hollow structure;
wherein the pedestal plate contains the master control circuit.

9. The rotating ring display device according to claim 8 wherein the pedestal plate further comprises a superior surface and an inferior surface;
wherein the inferior surface is a congruent end of the disk structure of the pedestal plate;
wherein the inferior surface is the congruent end of the pedestal plate that rests on the supporting surface;
wherein the superior surface is a congruent end of the disk structure of the pedestal plate;
wherein the superior surface is the congruent end of the pedestal plate that is distal from the inferior surface.

10. The rotating ring display device according to claim 9 wherein the display prism is a mechanical structure;
wherein the display prism forms the cantilever structure of the ring display structure;
wherein the span of the length of the outer dimension of the display prism is configured to be lesser than the span of the length of the inner dimension of the aperture of the ring such that the ring slides over the free end of the cantilever structure of the display prism.

11. The rotating ring display device according to claim 10 wherein a rotation circuit is an electric circuit;
wherein the rotation circuit controls the operation of the drive motor;
wherein the rotation circuit operates in the first mode to rotate the display prism around an arc of 360 degrees;
wherein the rotation circuit operates in the second mode to rotate the display prism back and forth across an arc of degrees;
wherein the rotation circuit discontinues the operation of the drive motor when the master switch is actuated to an open position.

12. The rotating ring display device according to claim 11 wherein the rotation circuit comprises a motor control circuit and a mode selection circuit;
wherein the motor control circuit and the mode selection circuit are electrically interconnected;
wherein the motor control circuit is an electric circuit;
wherein the motor control circuit transfers electric power from the master switch to the drive motor;
wherein the motor control circuit controls the operation of the drive motor of the ring display structure;
wherein the motor control circuit controls the direction of rotation of the drive motor;
wherein the motor control circuit controls the speed of rotation of the drive motor;
wherein the motor control circuit operates in the first mode to rotate the drive motor around an arc of 360 degrees;
wherein the motor control circuit operates in the second mode to rotate the drive motor back and forth across an arc of degrees;
wherein the mode selection circuit is an electric circuit;
wherein the mode selection circuit is a switching circuit;
wherein the mode selection circuit presents the motor control circuit with a first voltage indicating to the motor control circuit to operate the drive motor in the first mode;
wherein the mode selection circuit presents the motor control circuit with a second voltage indicating to the motor control circuit to operate the drive motor in the second mode.

13. The rotating ring display device according to claim 12 wherein the mode selection circuit comprises a first load resistor, a second load resistor, and a single throw double pole switch;
wherein the first load resistor, the second load resistor, and the single throw double pole switch are electrically interconnected;
wherein the single throw double pole switch is an electric switch;
wherein the single throw double pole switch actuates to a first position;
wherein in the first position, the single throw double pole switch forms a series electric connection between the master switch and the first load resistor;
wherein the single throw double pole switch actuates to a second position;
wherein in the second position, the single throw double pole switch forms a series electric connection between the master switch and the second load resistor;
wherein the first load resistor is a resistive circuit element;
wherein the first load resistor forms a series electric connection between the first position of the single throw double pole switch and the power circuit;
wherein the first load resistor forms a series electric connection between the first position of the single throw double pole switch and the first negative terminal of the battery of the power circuit;
wherein when the master switch is actuated to the closed position while the single throw double pole switch is simultaneously actuated to the first position, the first load resistor presents the first voltage to the motor control circuit that indicates that the motor control circuit operates in the first mode;
wherein the second load resistor is a resistive circuit element;
wherein the second load resistor forms a series electric connection between the second position of the single throw double pole switch and the power circuit;
wherein the second load resistor forms a series electric connection between the second position of the single throw double pole switch and the first negative terminal of the battery of the power circuit;
wherein when the master switch is actuated to the closed position while the single throw double pole switch is simultaneously actuated to the second position, the second load resistor presents the second voltage to the motor control circuit that indicates that the motor control circuit operates in the second mode.

14. The rotating ring display device according to claim 13 wherein the power circuit is an electrical circuit;
wherein the power circuit powers the operation of the master control circuit;
wherein the power circuit is an electrochemical device;
wherein the power circuit converts chemical potential energy into the electrical energy required to power the master control circuit;
wherein the power circuit comprises a battery, a diode, and a photovoltaic cell;
wherein the battery further comprises a first positive terminal and a first negative terminal;
wherein the photovoltaic cell further comprises a second positive terminal and a second negative terminal;
wherein the battery, the diode, and the photovoltaic cell are electrically interconnected;
wherein the battery is a rechargeable battery;
wherein the photovoltaic cell is an electrical device that converts light into electrical energy;

wherein the photovoltaic cell is directly wired to the battery;

wherein the photovoltaic cell is an electrical circuit that reverses the polarity of the rechargeable battery and provides the energy necessary to reverse the chemical processes that the rechargeable battery initially used to generate the electrical energy;

wherein the diode is an electrical device that allows current to flow in only one direction;

wherein the diode installs between the rechargeable battery and the photovoltaic cell such that electricity will not flow from the first positive terminal of the rechargeable battery into the second positive terminal of the photovoltaic cell.

* * * * *